United States Patent [19]

Beaudet

[11] Patent Number: 4,509,307

[45] Date of Patent: Apr. 9, 1985

[54] HEAT INSULATING PANEL

[75] Inventor: Emilien Beaudet, Chateaugway, Canada

[73] Assignee: Exxon Research and Engineering Co., Florham Park, N.J.

[21] Appl. No.: 517,912

[22] Filed: Jul. 28, 1983

Related U.S. Application Data

[63] Continuation-in-part of Ser. No. 321,272, Nov. 13, 1981.

[51] Int. Cl.[3] ..... E04C 2/24

[52] U.S. Cl. ..... 52/309.4

[58] Field of Search ..... 52/309.4, 309.8, 309.9, 52/408, 573, 393–395

[56] References Cited

U.S. PATENT DOCUMENTS

| | | | |
|---|---|---|---|
| 3,411,256 | 11/1968 | Best | 52/408 |
| 3,455,076 | 7/1969 | Clarvoe | 52/408 |
| 3,775,921 | 12/1973 | Avera | 52/573 |
| 4,095,383 | 6/1978 | Strobl | 52/309.9 |
| 4,227,356 | 10/1980 | Stern et al. | 52/309.4 |
| 4,282,697 | 8/1981 | Spielau et al. | 52/309.4 |

FOREIGN PATENT DOCUMENTS 746202 11/1966 Canada .

784410 5/1968 Canada .

*Primary Examiner*—James L. Ridgill, Jr.

*Attorney, Agent, or Firm*—Roylance, Abrams, Berdo & Goodman

[57] ABSTRACT

Curling of a composite roofing panel having a core of polymeric foam is inhibited by providing the core with at least one slit which opens through opposed edges of the panel and also through one of the major surfaces of the panel, adhering to that one of the major surfaces a lamina of non-foam material which is interrupted by the slit, covering the open edge of the slit with an elongated flexible tranversely strong tape adhesively secured to the portions of said at least one lamina adjacent the slit, and providing at least one additional lamina of non-foam material which overlies and is secured to the other major surface of the core and extends in unbroken fashion across the location of the slit, the slit affording space for relief of stresses resulting from shrinkage of the polymeric foam due to uneven loss of moisture and thereby inhibiting curling of the panel, the tape providing supplemental structural strength to allow handling of the panel despite presence of the slit, yet allowing limited movement of the side walls of the slit relative to each other as said stresses are relieved.

4 Claims, 6 Drawing Figures

HEAT INSULATING PANEL

RELATED APPLICATION

This is a continuation-in-part of my copending application Ser. No. 321,272, filed Nov. 13, 1981.

This invention relates to heat insulating panels having a core of foam material which are for use in construction of heat insulated building structures, such as a built-up roof, and more particularly, to an improved heat insulating panel which, when included in a built-up roof, will not curl to any great degree under the heat of the sun, hence reducing the amount of wrinkling which would normally occur in the covering membrane.

BACKGROUND OF THE INVENTION

The use of foamed plastic material for insulating purposes in building structures, such as exterior or partition walls, bulkheads, ceilings, floors, storage tanks, and roof structures is well known as such foamed plastic materials have a very low thermal conductivity. Such foamed plastic materials having low thermal conductivity may, for instance, comprise phenolic foam material such as, for example, thermoset phenol formaldehyde materials. Other low thermal conductivity foamed materials may comprise polystyrene form, polyurethane foam and/or polyisocyanurate foam. The foamed materials which are used as roofing insulation have a density of from about 1.5 to about 6 lb/ft$^3$ so as to have sufficient strength to support persons and their equipment.

Typically, in such construction applications the foamed material is sandwiched between a pair of protective skins, such as for example, paper or paper composites. The protective skins serve as a convenient aid in making the heat insulating panels and also protect and maintain the integrity of the foamed material.

One problem experienced with respect to such known heat insulating panels, such as roofing panels, is associated with the curling or warping of the panels. More particularly, during the construction of built-up roofs employing such heat insulating panels, the panels are initially applied, with a suitable adhesive, to the supporting structure, such as for example, to a corrugated steel roof deck, and then bituminized roofing materials are applied over the insulating panels to complete the roof structure.

The curling of the panels appears to be due in part to the fact that foamed material has a tendency to absorb and retain moisture. For example, foam materials have a tendency to absorb approximately 10% moisture by weight when in an environment at 50% relative humidity at room temperature. When such a panel is heated over one surface, for instance by sun radiation, the heat from the sun on this surface can cause a high temperature differential across the surfaces of the panel which can have the effect of driving the moisture in the foamed material away from the hot side toward the cool side of the panel and/or of uneven evaporation of the moisture from the panel. For example, up to a 25° C. differential (60° C. at the upper surface and 35° C. at the lower surface) has been experienced with unprotected heat insulating roof panels. This high temperature differential in part causes the curling or warpage of the panels due to the removal of moisture near the upper surface of the panel which then shrinks relative to the region near the lower surface which has retained a higher amount of moisture. As an example, curling of up to 1 inch has been observed in a 2 inch thick roofing panel constructed of a phenolic foam core sandwiched between a pair of paper sheets, when exposed to full sun on a hot day.

In an attempt to overcome the curling effect in foam panels, it has been proposed to use a thin layer of reflecting material such as aluminum foil on the upper surface of the panel so that the sun radiation tends to be reflected from the upper surface of the panel so reducing the amount of heat which flows through into the foam core. Such a system works well to prevent curling of panels on a roof before they are covered with a roofing membrane; however, after the membrane has been applied, the effectiveness of the reflecting material is reduced and curling of the panel is liable to occur, especially where there is a lack of adhesive between the panel and the roofing structure. Such curling in a built-up roof will wrinkle the membrane.

SUMMARY OF THE INVENTION

In accordance with the present invention, the amount of curling produced in a roofing panel by exposure of a built-up roof to heat, such as from the sun on a very hot day, is drastically reduced by slitting the panel from the lower face approximately up to the inner surface of the upper face. This slit is formed preferentially along the machine length of the panel as most curling seems to occur along the machine length, and prevents curling of the panel when it is exposed to the sun by relieving stress build-up in the lower region of the panel as the region near the upper surface of the panel contracts due to a lowering of the moisture content. The structural integrity of the panel is retained by placing adhesive tape over the slit so that the panel can then be handled in the same manner as an unslit panel. By using this type of panel in a built-up roof, the amount of wrinkling of the roof membrane is minimized when the panel is not well secured by adhesive to a roofing structure. The slit can be used to advantage in any type of panel made from a foam which is dimensionally thermo- or hydro-sensitive, and can with advantage be also used with a foam panel which already has a reflective upper surface to further enhance the advantages of such a panel. In particularly advantageous embodiments, the slit is of significant width and the adhesive tape covering the slit has a loop which extends lengthwise of the slit and is centered with respect thereto.

IDENTIFICATION OF THE DRAWINGS

DETAILED DESCRIPTION OF THE INVENTION

Figure 1:
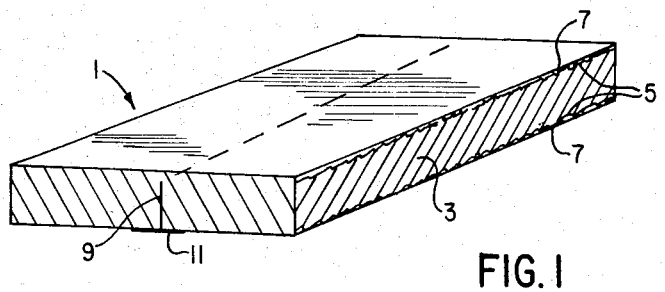
FIG. 1 is a perspective view of a panel according to one embodiment of the invention.

Referring now to FIG. 1, panel 1 comprises a foamed core 3, corrugated paperboard layers 5 and outer liners 7 adhered to the crests of the corrugated layer with a suitable adhesive, such as for example with a wet strength adhesive. A slit 9 of rectangular transverse cross section, extending through the panel from the lower surface to below the corrugated layer, extends from one end of the panel to the other, preferably in a longitudinal fashion as shown. Although one slit 9 is shown, a plurality of slits can be used, especially where wider panels are being manufactured, and also the slits can be in any other direction than longitudinal. The cross-sectional shape of the slit can also be of a different shape than that shown. In order to be able to handle the slitted panel, a strip of adhesive tape 11 is placed over the opening of the slit and along its length, so providing a structural rigidity of the panel. The adhesive tape is such that it will be strong in transverse tension and flexible.

Figure 2:
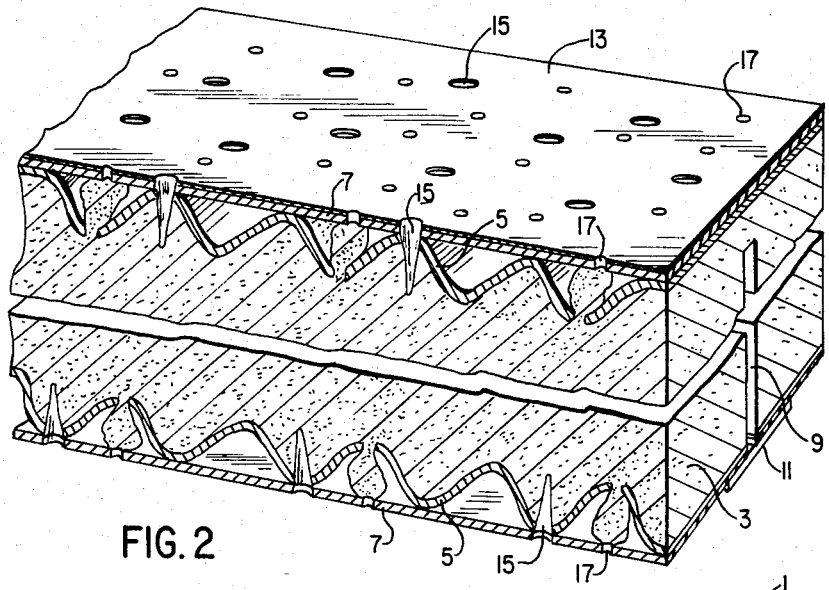
FIG. 2 is an enlarged fragmentary cross-sectional perspective view of a panel similar to that of FIG. 1 but including a heat reflecting layer.

FIG. 2 shows an enlarged view of a modified form of panel as shown in FIG. 1 which, in addition to corrugated layers 5 and outer liners 7, also includes a reflective layer 13 which is already known for use in reflecting part of the sun's radiation away from the panel so that the amount of heat absorbed into the foamed core 3 is reduced. Perforations 15 and 17 are shown through the outer liners and the layer of reflecting material, these being for the purpose of permitting passage of moisture from the core to the ambient surroundings. The perforations also provide keying between the roofing membrane, such as asphalt roofing materials, and the panel, as asphalt will run into the perforations as the roofing membrane is being applied. Slit 9 is again formed in the panel as shown in FIG. 2 extending from the lower surface up to the corrugated layer, and a strip of adhesive tape 11 is stuck over and along the opening of the slit. Although the slit is shown extending up to the corrugated layer, it can extend to a region just below this layer without greatly affecting the panel characteristics.

Figure 3:
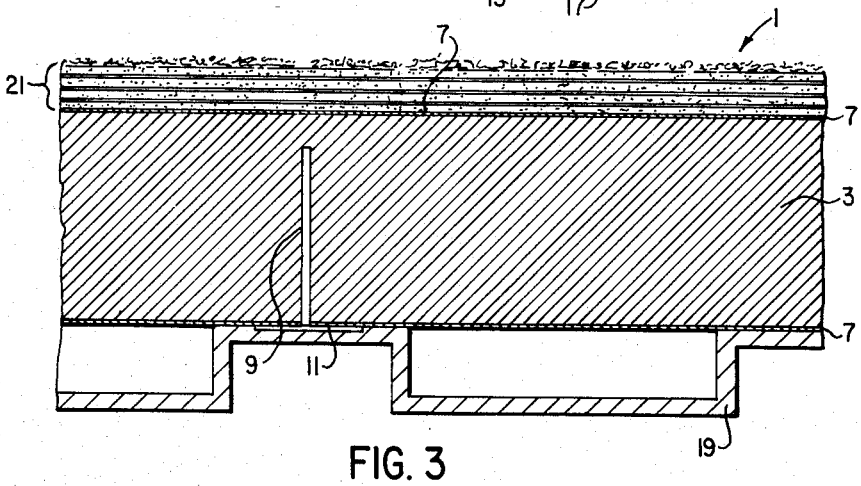
FIG. 3 is a cross-sectional view of part of the panel shown in FIG. 2 supported upon a roof supporting structure and with roofing material applied thereon to form a composite built-up roofing structure.

FIG. 3 shows a roof construction utilizing the slit and taped board as in FIG. 2 and a roof supporting structure 19 upon which a roofing panel 1 is adhesively secured by, for instance, roofing adhesive. Upon the roofing panel are applied a plurality of layers of roofing materials such as alternate layers of asphalt and asphalt saturated roofing felts generally designated as 21 to form a roofing membrane which is covered with gravel to make a finished roof structure.

By utilizing the panel of this invention in making a built-up roof, it is thus seen that after installation of the panels in a built-up roof, when the roof is subject to heating by the sun, the stresses which occur in the panel due to foamed core shrinkage through an uneven loss of moisture, are relieved by the slit through the panel and curling of the panel is not liable to occur. There will therefore be a minimum of wrinkling of the membrane even when the roofing panel is not correctly and completely adhesively secured to the roofing structure.

Figure 4:
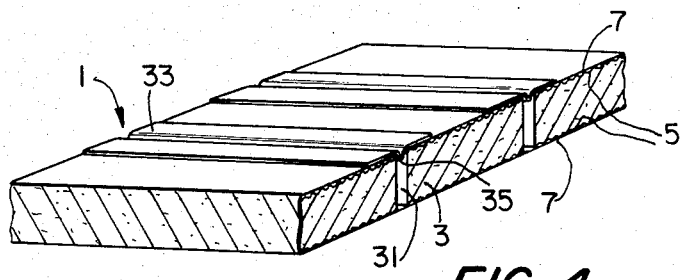
FIG. 4 is a perspective view, in partial cross section, of a panel according to another embodiment.
Figure 5:
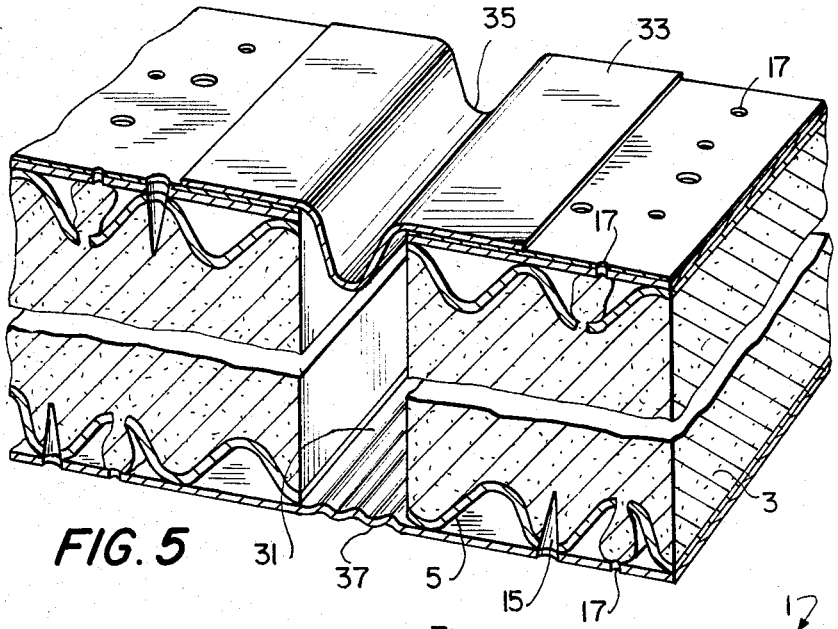
FIG. 5 is an enlarged fragmentary cross-sectional perspective view of the panel of FIG. 4.
Figure 6:
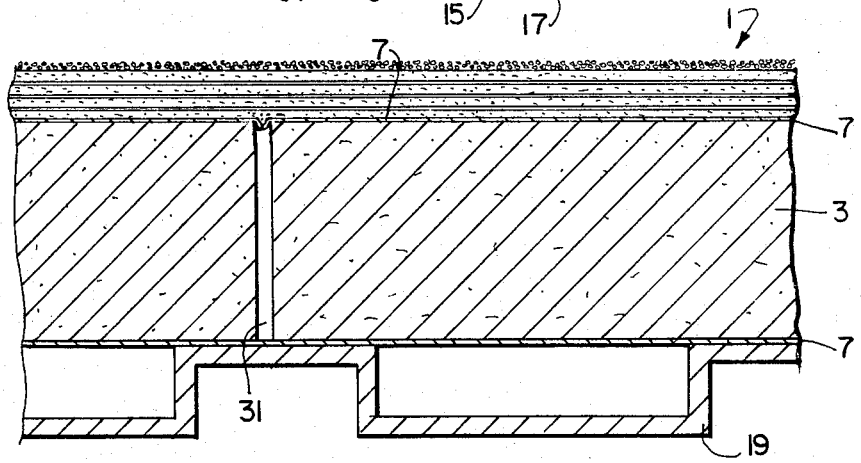
FIG. 6 is a fragmentary cross-sectional view of the panel of FIGS. 4 and 5 applied to a roof supporting structure and having roofing material applied thereto.

It has been found that even better non-curling properties are achieved by making a slit from one surface of the panel, through the foamed core and up to the second surface of the panel and placing the adhesive tape over the opening of the slit with a loop being formed in the adhesive tape and extending longitudinally of the slit. More movement of the parts of the panel is therefore permitted because of the expansion and contraction allowed by the loop in the adhesive tape and by crushing of the other surface of the panel in the region of the slit. As seen in FIGS. 4 and 5, panel 1 of this embodiment comprises foamed core 3, corrugated paperboard layers 5 and outer liners 7, and has a rectangular slit 31 extending through the top surface of the panel to a location above the lower surface of the panel, e.g., to but not into lower liner 7. An adhesive tape 33 is placed over the top of the slit and is so positioned that excess material of the adhesive tape forms a longitudinally extending loop or groove 35. As seen in FIG. 5, the lower liner of the board can bend and buckle, as indicated at 37, to accommodate internal expansion and contraction of the panel. The manner in which panels according to this embodiment are installed and coated with roofing material is shown in FIG. 6.

Although the illustrated embodiments include perforations in the protective layers of the panel, it will be appreciated that the use of perforations is not absolutely necessary and a wide variety of types and configurations of protective layers 5 and 7 can be used as long as they are compatible with the chemical composition of the foam core.

While particularly advantageous embodiments of the invention have been shown and described, it will be understood that such are merely illustrative and that changes can be made without departing from the scope of the invention as claimed.

What is claimed is:

1. In a composite roofing panel, the combination of an insulating core of polymeric foam, the core having an upper surface, a lower surface, two oppositely disposed edge surfaces, and an elongated slit extending between and opening through said edge surfaces and also opening along its length through one of the upper surface and the lower surface;

at least one lamina of non-foam material overlying and secured to said one of the upper and lower surfaces;

said at least one lamina being interrupted by the slit;

an elongated flexible transversely strong tape covering the slit and adhesively secured to the portions of said at least one lamina of non-foam material adjacent the slit, the slit presenting side walls which are spaced apart when the tape is relaxed and undeformed; and at least one additional lamina of non-foam material overlying and secured to the other of the upper and lower surfaces and extending in unbroken fashion across the location of the slit;

the slit affording space for relief of stresses resulting from shrinkage of the insulating core of polymeric foam due to uneven loss of moisture and thereby inhibiting curling of the panel which would otherwise result from such stresses;

the tape providing supplemental structural strength to allow handling of the panel despite presence of the slit, yet also allowing limited movement of the side walls of the slit relative to each other as said stresses are relieved.

2. The combination defined by claim 1, wherein said one of the upper and lower surfaces is the lower surface; and the slit penetrates the core to a line adjacent the upper surface.

3. The combination defined by claim 1, wherein the slit is of significant width; and the tape is formed with a loop which extends lengthwise of the tape and projects into the slit.

4. The combination defined by claim 3, wherein the slit also opens through the other of the upper and lower surfaces; and said at least one additional lamina extends across the slit in unbroken fashion and is of a material capable of bending and buckling as the side walls of the slit move relative to each other.

* * * * *